US008271284B2

(12) United States Patent
Kato

(10) Patent No.: US 8,271,284 B2
(45) Date of Patent: Sep. 18, 2012

(54) SPEECH SYNTHESIS DEVICE, METHOD, AND PROGRAM

(75) Inventor: Masanori Kato, Tokyo (JP)

(73) Assignee: NEC Corporation, Tokyo (JP)

( * ) Notice: Subject to any disclaimer, the term of this patent is extended or adjusted under 35 U.S.C. 154(b) by 823 days.

(21) Appl. No.: 12/374,609

(22) PCT Filed: Jul. 4, 2007

(86) PCT No.: PCT/JP2007/063351

§ 371 (c)(1),
(2), (4) Date: Jan. 21, 2009

(87) PCT Pub. No.: WO2008/010413

PCT Pub. Date: Jan. 24, 2008

(65) Prior Publication Data

US 2009/0177475 A1 Jul. 9, 2009

(30) Foreign Application Priority Data

Jul. 21, 2006 (JP) ..... 2006-199228

(51) Int. Cl.
*G10L 13/08* (2006.01)

(52) U.S. Cl. ..... 704/260; 704/258; 704/261

(58) Field of Classification Search ..... 704/207, 704/218, 258, 260, 266, 209, 205, 206, 261, 704/265

See application file for complete search history.

(56) References Cited

U.S. PATENT DOCUMENTS 6,226,606 B1 * 5/2001 Acero et al. ..... 704/218
7,630,883 B2 * 12/2009 Sato ..... 704/207

FOREIGN PATENT DOCUMENTS

| | | |
|---|---|---|
| JP | 02-197899 | 8/1990 |
| JP | 02-197900 | 8/1990 |
| JP | 03-269599 | 12/1991 |
| JP | 04-214600 | 8/1992 |
| JP | 06-250685 | 9/1994 |
| JP | 08-160993 | 6/1996 |
| JP | 08-202395 | 8/1996 |

(Continued)

OTHER PUBLICATIONS

Huang et al., "Spoken Language Processing," Prentice Hall, pp. 689-836, 2001.

(Continued)

*Primary Examiner* — Huyen X. Vo
(74) *Attorney, Agent, or Firm* — Scully, Scott, Murphy & Presser PC

(57) ABSTRACT

Even when a pitch cycle has a large fluctuation and the pitch cycle string changes abruptly, it possible to suppress the affect of the pitch cycle fluctuation and generate high-quality synthesized speech. A speech synthesis device generates a synthesized speech corresponding to an input text sentence according to an original speech waveform stored in original speech waveform information storage unit (25). The speech synthesis device includes pitch cycle correction unit (40) which extracts a fluctuation component of the pitch cycle of the original speech waveform which is obtained from original speech waveform information storage unit (25) in order to generate the synthesized speech and which corrects, based on the extracted fluctuation component, the pitch cycle of the synthesized speech obtained by analyzing the input text sentence. Pitch cycle correction unit (40) connects the pitch cycle waveform of the original speech waveform at the pitch cycle of the corrected synthesized speech.

9 Claims, 10 Drawing Sheets

FOREIGN PATENT DOCUMENTS

| | | |
|---|---|---|
| JP | 10-124082 | 5/1998 |
| JP | 2893697 | 3/1999 |
| JP | 2000-214877 | 8/2000 |
| JP | 2003-255998 | 9/2003 |
| JP | 2004-150280 | 5/2007 |

OTHER PUBLICATIONS

Ishikawa, "Prosodic Control for Japanese Text-to-Speech Synthesis," Technical Report of The Institute of IEICE, The Institute of Electronics, Information and Communication Engineers, vol. 100, No. 392, pp. 27-34, 2000.

Abe, "An Introduction to Speech Synthesis Units," Technical Report of The Institute of IEICE, The Institute of Electronics, Information and Communication Engineers, vol. 100, No. 392, pp. 35-42, 2000.

Moulines et al., "Pitch-Synchronous Waveform Processing Techniques for Text-To-Speech Synthesis Using Diphones," Speech Communication 9, pp. 435-567, 1990.

Kawamata et al., "Two-Dimensional Signal and Image Processing," Society of Instrument and Control Engineers, 1996.

Arakawa et al., "A Method of Reducing Noise for Speech Signals Using Component Separating ϵ-Filters," Transactions A of Institute of Electronics, Information, and Communication Engineers, vol. J85-A, No. 10, pp. 1059-1069, 2002.

Boll, "Suppression of Acoustic Noise in Speech Using Spectral Subtraction," IEEE Transactions on Acoustics, Speech, and Signal Processing, vol. ASSP-27, No. 2, pp. 113-120, Apr. 1979.

Tanihagi, "Theory of Digital Signal Processing," vol. 2, Corona Publishing Co. Ltd, 1985.

Ephraim, Yariv, "Speech Enhancement Using a Minimum Mean-Square Error Short-Time Spectral Amplitude Estimator", IEEE Transactions on Acoustics, Speech, and Signal Processing, Dec. 1984; pp. 1109-1121, vol. ASSP-32, No. 6.

* cited by examiner

SPEECH SYNTHESIS DEVICE, METHOD, AND PROGRAM

TECHNICAL FIELD

The present invention relates to speech synthesis technologies, and more particularly, to a speech synthesis device for synthesizing speech based on a text.

BACKGROUND ART

Conventionally, a variety of speech synthesis devices have been developed for analyzing a text sentence, and generating synthesized speech from speech information represented by the sentence through a rule synthesis. As documents which disclose related arts, there are Patent Document 1 (Japanese Patent No. 2893697), Non-Patent Document 1 (Huang, Acero, Hon; "Spoken Language Processing," Prentice Hall, pp. 689-836, 2001), Non-Patent Document 2(Ishikawa, "Prosodic Control for Japanese Text-to-Speech Synthesis," Technical Report of The Institute of IEICE, The Institute of Electronics, Information and Communication Engineers, Vol. 100, No. 392, pp. 27-34, 2000), Non-Patent Document 3(Abe, "An Introduction To Speech Synthesis Units," Technical Report of The Institute of IEICE, The Institute of Electronics, Information and Communication Engineers, Vol. 100, No. 392, pp. 35-42, 2000), and Non-Patent Document 4(Moulines Charapentier: "Pitch-synchronous Waveform processing Techniques For Text-To-Speech Synthesis Using Diphones," Speech Communication 9, pp. 435-567, 1990).

FIG. 1 is a block diagram showing an exemplary configuration of a general rule-synthesis type speech synthesis device. Referring to FIG. 1, the speech synthesis device comprises text analysis unit 20, prosodic feature generation unit 21, phoneme selection unit 22, prosodic feature control unit 23, waveform connection unit 24, and original speech waveform information storage unit 25.

Original speech waveform information storage unit 25 comprises phoneme waveform storage unit 27 which stores original speech waveforms in phoneme units, and additional information storage unit 26 which stores attribute information of each phoneme waveform. Here, the original speech waveform refers to a natural speech waveform which has been previously collected for use in the generation of synthesized speech, while the attribute information of an original speech waveform refers to phonemic information and prosodic information such as a phonemic environment in which an original speech waveform was generated, a pitch frequency, an amplitude, continuation time length information and the like. Also, an original speech waveform divided into phonemes is referred to as a "phonemic waveform" Details on the length and unit of phonemes are described in Non-Patent Documents 1, 3.

Text analysis unit 20 performs a morpheme analysis, a syntactic analysis, and analyses such as reading on an input text sentence, and supplies prosodic feature generation unit 21 and phoneme selection unit 22 with a symbol string representative of "reading" and a part of speech, conjugation, accent type and the like of phonemes as text analysis results. Prosodic feature generation unit 21 generates prosodic feature information (information related to a pitch, a time length, power and the like) of synthesized speech based on the text analysis result supplied from text analysis unit 20, and supplies the prosodic feature information to phoneme selection unit 22, prosodic feature control unit 23, and waveform connection unit 24, respectively.

Phoneme selection unit 22 selects a phoneme waveform, which has a high compatibility between the text result supplied from text analysis unit 20 and the prosodic feature information supplied from prosodic feature generation unit 21, from phoneme waveforms stored in original speech waveform information storage unit 25, and supplies prosodic feature control unit 23 with the selected phoneme waveform together with the additional information.

Prosodic feature control unit 23 generates a waveform having a prosodic feature generated by prosodic feature generation unit 21 from the phoneme waveform selected by phoneme selection unit 22, and supplies the generated waveform (phoneme waveform) to waveform connection unit 24. Waveform connection unit 24 connects the phoneme waveform supplied from prosodic feature control unit 23 to output the connected waveform as synthesized speech.

Prosodic feature control unit 23 performs processing which differs in contents depending on the type and content of generated prosodic feature information because it generates a waveform which has a prosodic feature equivalent to the prosodic feature information generated by prosodic feature generation unit 21. In the configuration shown in FIG. 1, since it is assumed that the prosodic feature information generated by prosodic feature generation unit 21 is comprised of information related to three components, pitch frequency, continuation time length, and power, prosodic feature control unit 23 comprises pitch frequency control unit 30, continuation time length control unit 36, and power control unit 37. Pitch frequency control unit changes the pitch frequency; continuation time length control unit 36 changes the continuation time length; and power control unit 37 changes the power.

There is a scheme in which rearranges pitch waveforms (waveforms having a time length of several pitch lengths) extracted from original speech waveforms are rearranged at a pitch cycle of synthesized speech, as a pitch frequency control schemes generally used in the rule-synthesis type speech synthesis device shown in FIG. 1. Here, the pitch cycle is defined by the inverse of the pitch frequency, and it represents the interval of pitch waveform. Specifically, a pitch waveform is first extracted at a pitch cycle that is previously estimated from an original speech waveform using windowing processing or the like. Then, pitch waveforms are connected at pitch cycle intervals generated from prosodic feature information of synthesized speech. The pitch cycle of the original speech waveform is often defined on the basis of the pitch frequency estimated from the original speech waveform.

In pitch frequency control unit 30, pitch cycle acquisition unit 32 first acquires a pitch cycle of a phoneme waveform from original speech prosodic feature information, and pitch waveform extraction unit 35 extracts pitch waveforms from the phoneme waveform at intervals of the pitch cycle acquired by pitch cycle acquisition unit 32. Then, pitch waveform connection unit 34 connects the pitch waveforms extracted by pitch waveform extraction unit 35 at intervals of the pitch cycle of the synthesized speech acquired by pitch cycle acquisition unit 31.

The pitch waveform extraction processing can be omitted if the pitch waveform has been previously stored in original speech waveform information storage unit 25 without extracting the pitch waveform during the speech synthesis. In this event, during the speech synthesis, a pitch waveform, rather than a phoneme waveform, is read from original speech waveform information storage unit 25, and connection processing is performed by pitch waveform connection unit 34. In the following description, a pitch cycle of an original speech waveform is referred to as the "original speech pitch cycle," and a pitch cycle generated from prosodic feature information of synthesized speech is referred to as the "synthesized speech pitch cycle." A representative pitch frequency control scheme may be a PSOLA scheme described in Non-Patent Document 4. In a speech synthesis scheme which utilizes a linear prediction analysis, predicted residual waveforms are subjected to rearrangement, instead of pitch waveforms.

In a general pitch frequency control scheme, a pitch cycle and pitch frequency of original speech fluctuate when the pitch cycle and pitch frequency are found from an original speech waveform, causing a degradation in quality of synthesized speech due to the fluctuations. The fluctuation in pitch cycle refers to a phenomenon in which adjacent pitch waveforms slightly differ in pitch cycle from one another. For example, the fluctuation in pitch cycle is a phenomenon in which a time string of estimated pitch cycles changes such as 201, 198, 200, 199, 202, . . . in a section in which the pitch cycle is 200. From the fact that no fluctuation component exists in a true original speech pitch cycle, the fluctuation component is thought to be an estimation error of a pith cycle which is produced when the pitch cycle is obtained from a waveform. When a true original speech pitch cycle and a fluctuation component are regarded as distinct types of signals, the fluctuation component is a signal which has a smaller amplitude and power than those of the true original speech pitch cycle, and is dominated by high frequency components (mainly comprised of high frequency components). If the pitch frequency is changed without considering this fluctuation, synthesized speech is degraded in sound quality.

For solving the foregoing problem in speech synthesis devices, Patent Document 1 discloses a method of smoothing original speech pitch cycles when the pitch cycle of predicted residual waveform is changed, targeting a speech synthesis device which employs a linear prediction analysis. The method of Patent Document 1 involves smoothing a time string of original speech pitch cycles (pitch cycle string) through a moving average, and correcting synthesized speech for the pitch cycle by using the smoothed original speech pitch cycle. Then, a predicted residual waveform string is generated at the corrected pitch cycle of the synthesized speech.

According to the method described in Patent Document 1, pitch cycle tk' in smoothing intended frame k is given by the following equation when a frame number is i (where i=0, 1, 2, . . . ), the pitch cycle of the original speech before smoothing is ti, and the pitch cycle of the original speech after smoothing is ti':

$$t'_k = \frac{1}{2W+1}\sum_{i=-w}^{w} t_{k+i} \qquad \text{[Expression 1]}$$

where w is a window width of the moving average. In Patent Document 1, window width w of moving average is chosen to be "1."

DISCLOSURE OF THE INVENTION

However, in a speech synthesis device which performs the smoothing processing of the original speech pitch cycle as described in Patent Document 1, since the pitch smoothing processing is performed through a moving average of the pitch cycle string, fluctuations in pitch cycle cannot be sufficiently suppressed in some cases if a small window width is chosen for the moving average. Also, if the window width of the moving average is increased for purposes of sufficiently suppressing fluctuations in pitch cycle, pitch cycles in the previous and following frames more largely affect a pitch cycle of a smoothing target frame, resulting in a larger error in pitch cycle before smoothing and after smoothing. Thus, when the pitch cycle is changed, a changing error increases to degrade the sound quality of synthesized speech. Particularly, when a pitch cycle string suddenly largely changes at some point, the suddenly changing point exerts even larger influence on frames previous and subsequent thereto, resulting in larger errors in pitch cycle as a whole. Thus, the aforementioned speech synthesis device has a problem in which it is unable to sufficiently suppress the fluctuations in pitch cycle and it is unable to improve the sound quality of synthesized speech.

It is an object of the present invention to provide a speech synthesis device which is capable of solving the problem described above, sufficiently suppressing fluctuations in pitch cycle, and improving the sound quality of synthesized speech as well.

To achieve the above object, a first invention is a speech synthesis device includes a storage unit which stores original speech waveforms that have been previously acquired, for generating synthesized speech corresponding to an input text sentence based on an original speech waveform stored in the storage unit, characterized by comprising fluctuation component extracting means for extracting a fluctuation component of a pitch cycle of a pitch waveform (unit waveform) which constitutes an original speech waveform obtained from the storage unit in order to generate the synthesized speech, a synthesized speech pitch cycle correction unit for correcting a pitch cycle of the synthesized speech generated by analyzing the input text sentence based on the fluctuation component extracted by the fluctuation component extracting means, and a pitch waveform connection unit for connecting, at the pitch cycle of the synthesized speech corrected by the synthesized speech pitch cycle correction unit the pitch waveform of the original speech waveform obtained from the storage unit.

According to the first invention described above, a fluctuation component of a pitch cycle is extracted from an original speech waveform, and a pitch cycle of synthesized speech is corrected on the basis of the extracted fluctuation component, so that the pitch cycle can be suppressed in fluctuation irrespectively of a window width of moving average. Accordingly, no problem will arise, such as degradation in sound quality of the synthesized speech due to an increase in changing error when the pitch cycle of the synthesized speech is changed, as is the case with a method which involves pitch smoothing processing through a moving average of a pitch cycle string, as described above. Also, errors in pitch cycle will not grow even when the fluctuation component is large or even when a sudden change of pitch occurs within the original speech pitch cycle string. In this way, the fluctuation component of the pitch cycle can be extracted from the original speech waveform, without being affected by large fluctuations in the pitch cycle of the original speech waveform, and the synthesized speech pitch cycle can be corrected using the extracted fluctuation component.

A speech synthesis device of a second invention is a speech synthesis device includes a storage unit which stores original speech waveforms that have been previously acquired, for generating synthesized speech corresponding to an input text sentence based on an original speech waveform stored in the storage unit, characterized by comprising a conversion ratio calculation unit for calculating a conversion ratio of a pitch cycle of a pitch waveform (unit waveform) which is obtained from the storage unit and which constitutes an original speech waveform for generating the synthesized speech to a pitch cycle of the synthesized speech obtained by analyzing the input text sentence, fluctuation component suppressing means for suppressing a fluctuation component of a pitch cycle of a pitch waveform of the original speech waveform, the fluctuation component being reflected in the conversion ratio calculated by the conversion ratio calculation unit, a synthesized speech pitch cycle correction unit for correcting the pitch cycle of the synthesized speech based on the pitch cycle of the pitch waveform of the original speech waveform and the conversion ratio in which the fluctuation component is suppressed by the fluctuation component suppressing means, and a pitch waveform connection unit for connecting, at the pitch cycle of the synthesized speech corrected by the synthesized speech pitch cycle correction unit, the pitch waveform of the original speech waveform obtained from the storage unit.

According to the second invention described above, since a pitch cycle of synthesized speech is corrected on the basis of the conversion ratio with a suppressed fluctuation component fluctuations in pitch cycle can be suppressed irrespective of a window width of the moving average. Accordingly, like the first invention, the fluctuation component of the pitch cycle can be extracted from the original speech waveform, without being affected by large fluctuations in the pitch cycle of the original speech waveform, and the synthesized speech pitch cycle can be corrected using the extracted fluctuation component.

According to the present invention as described above, the fluctuation component is highly accurately extracted, and the synthesized speech is generated while the extracted fluctuation component is reflected in the pitch cycle of the synthesized speech, so that the sensation of noise caused by fluctuations in pitch cycle is alleviated, resulting in improved sound quality of the synthesized speech. In addition, when the pitch cycle of the pitch waveform (unit waveform) is changed, the influence of fluctuations in the pitch waveform can be sufficiently reduced without producing large pitch cycle changing errors, thus making it possible to improve the sound quality of the synthesized speech, while restraining the influence of the fluctuations in pitch cycle, even when the pitch cycle largely fluctuates, or even when a sudden change of pitch occurs within the original speech pitch cycle string.

A block diagram showing an exemplary configuration of a general rule-synthesis type speech synthesis device.

FIG. 2

A block diagram generally showing the configuration of a speech synthesis device which is a first embodiment of the present invention.

FIG. 3

Figure 2:
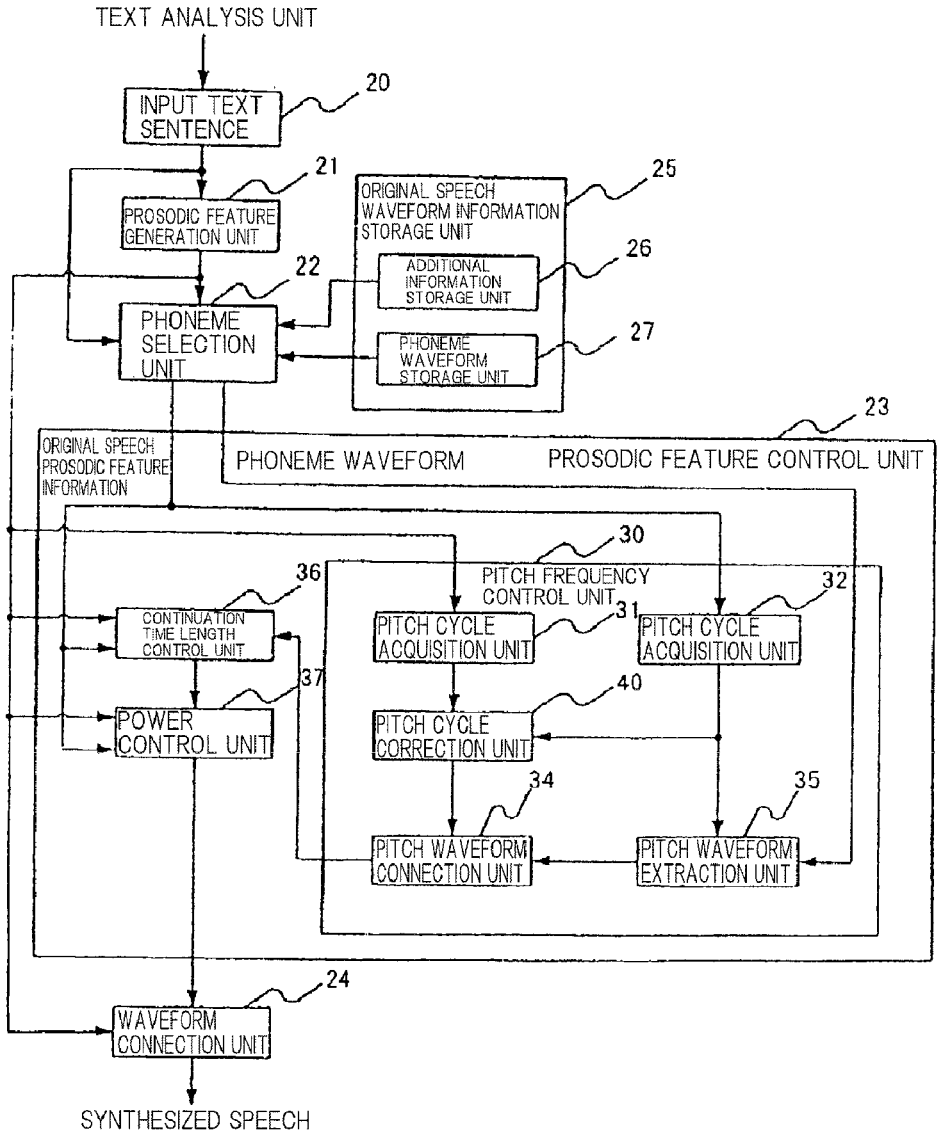

A block diagram showing the configuration of a pitch cycle correction unit shown in FIG. 2.

FIG. 4

Figure 3:
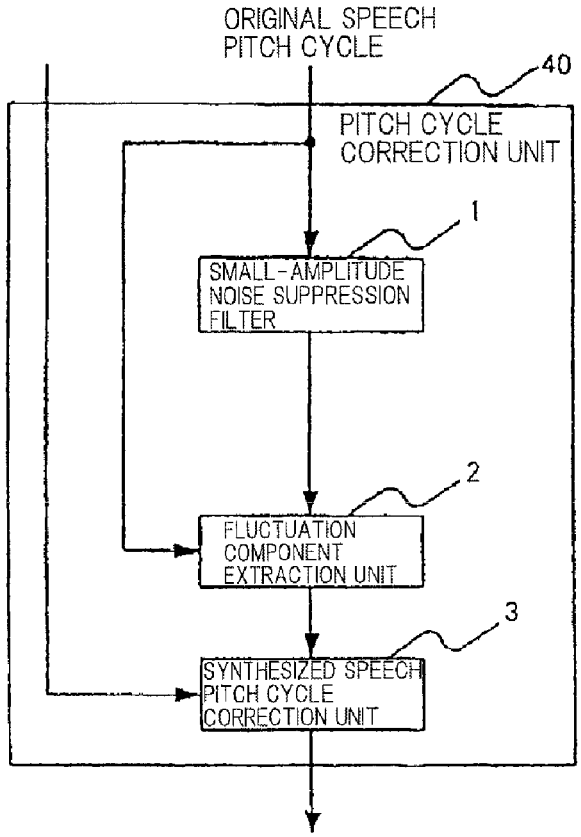

A flow chart for describing a correction operation of the pitch cycle correction unit shown in FIG. 3.

FIG. 5

A block diagram generally showing the configuration of a speech synthesis device which is a second embodiment of the present invention.

FIG. 6

Figure 5:
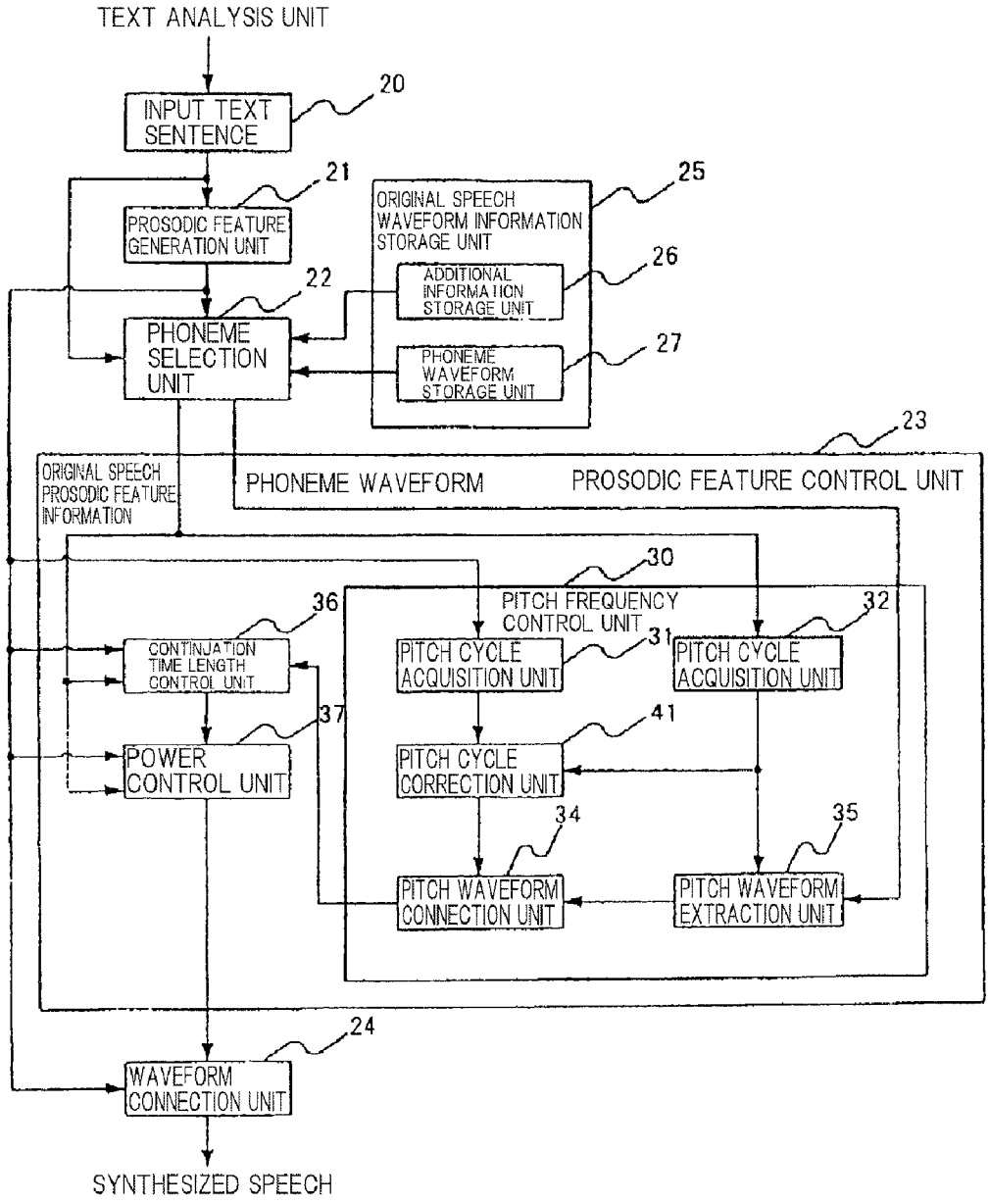

A block diagram showing the configuration of a pitch cycle correction unit shown in FIG. 5.

FIG. 7

Figure 6:
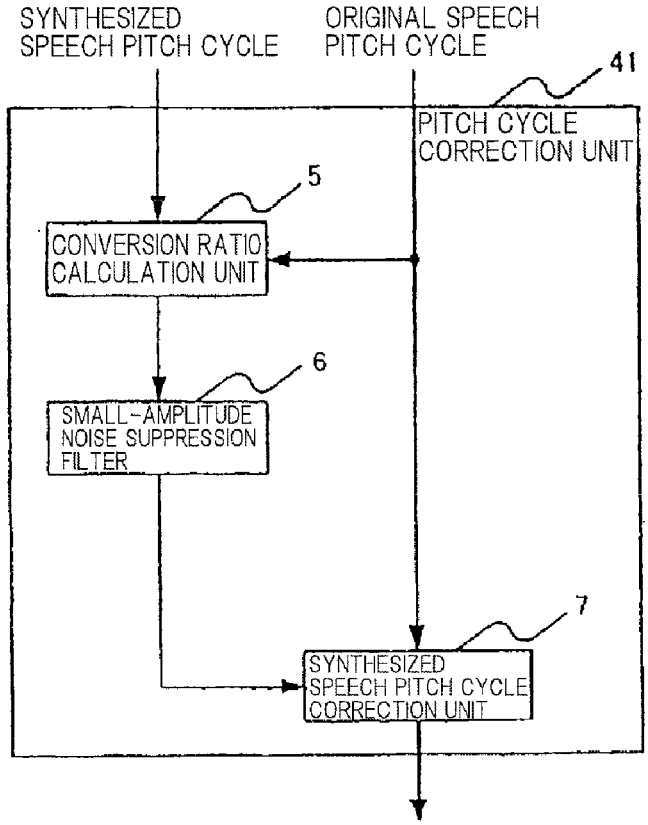

A flow chart for describing a correction operation of the pitch cycle correction unit shown in FIG. 6.

FIG. 8

A block diagram generally showing the configuration of a speech synthesis device which is a third embodiment of the present invention.

FIG. 9

Figure 8:
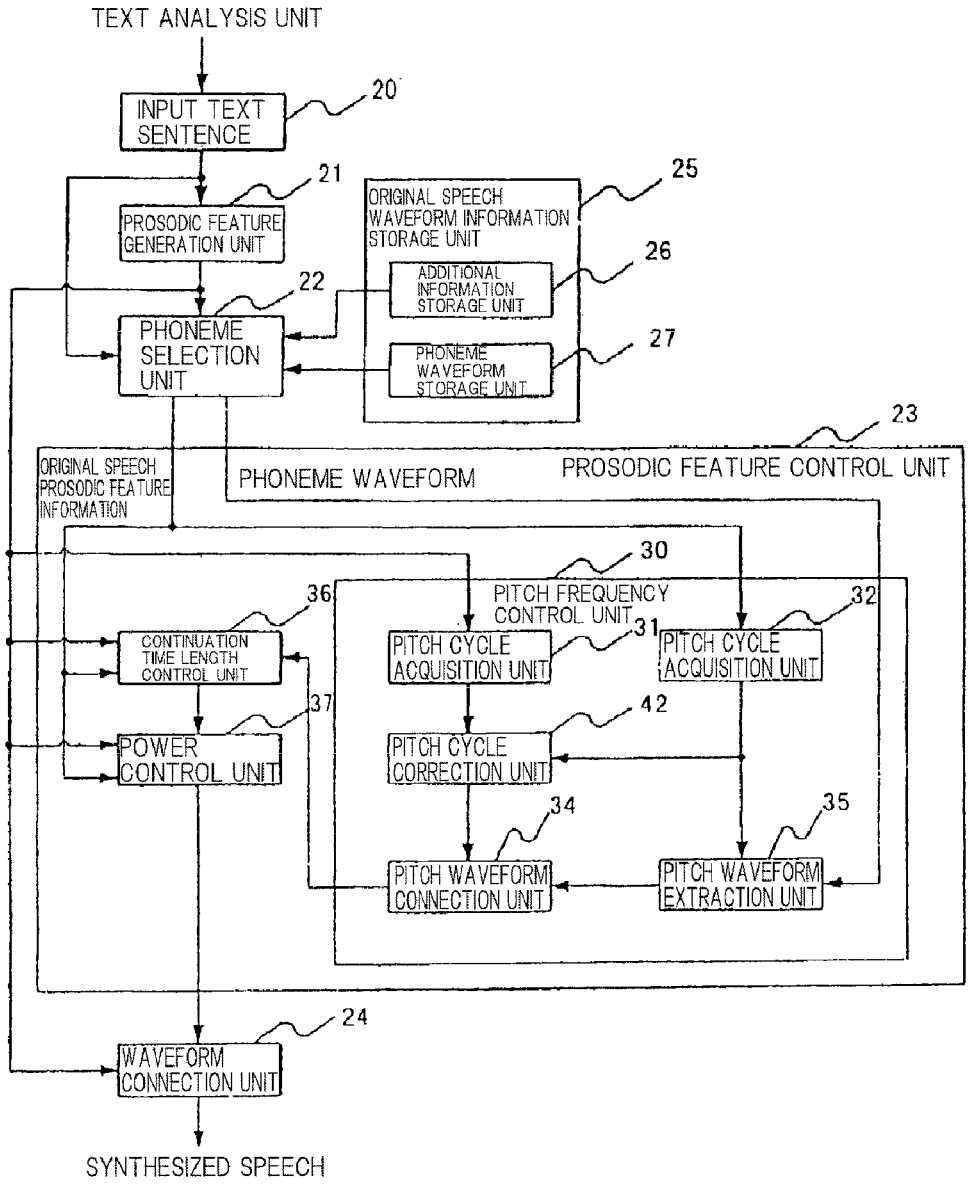

A block diagram showing the configuration of a pitch cycle correction unit shown in FIG. 8.

FIG. 10A

A diagram for describing the frequency characteristic of an original speech pitch cycle string, which is a characteristic diagram when a fluctuation component and the original speech pitch cycle string do not overlap in a frequency band.

FIG. 10B

A diagram for describing the frequency characteristic of an original speech pitch cycle string, which is a characteristic diagram when a fluctuation component and the original speech pitch cycle string overlap in a frequency band.

FIG. 11

A characteristic diagram of a high pass filter.

FIG. 12

A flow chart for describing a correction operation of a pitch cycle correction unit shown in FIG. 8.

FIG. 13

A block diagram generally showing the configuration of a speech synthesis device which is a fourth embodiment of the present invention.

FIG. 14

Figure 13:
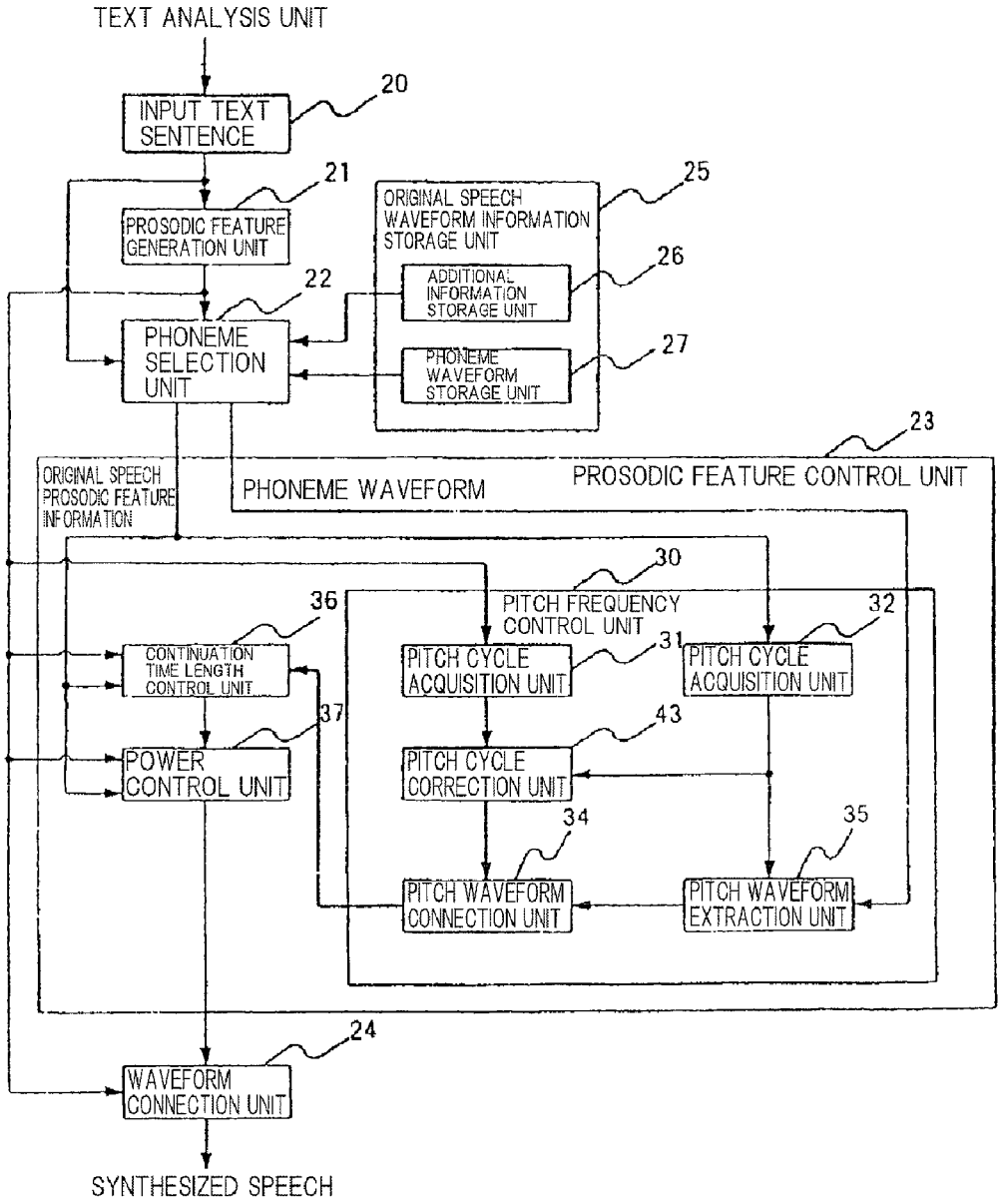

A block diagram showing the configuration of a pitch cycle correction unit shown in FIG. 13.

FIG. 15

Figure 14:
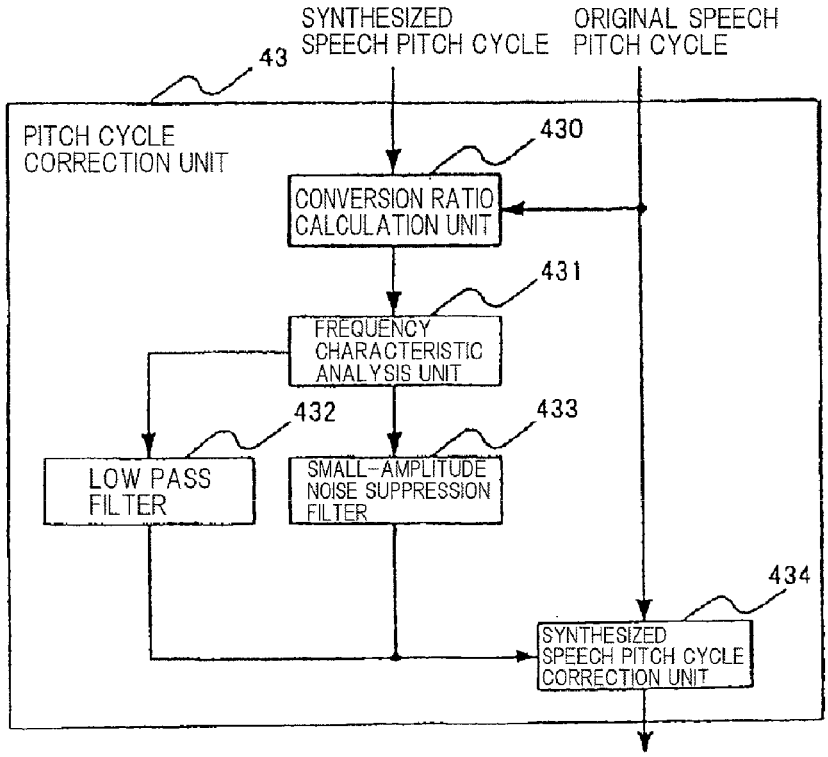

A flow chart for describing a correction operation of the pitch cycle correction unit shown in FIG. 14.

DESCRIPTION OF REFERENCE NUMERALS

20 Text Analysis Unit
21 Prosodic Feature Generation Unit
22 Phoneme Selection Unit
23 Prosodic Feature Control Unit
24 Waveform Connection Unit
25 Original Speech Waveform Information Storage Unit
26 Additional Information Storage Unit
27 Phoneme Waveform Storage Unit
30 Pitch Frequency Control Unit
31, 32 Pitch Acquisition Units
34 Pitch Waveform Connection Unit
35 Pitch Waveform Extraction Unit
36 Continuation Time Length Control Unit
37 Power Control Unit
40 Pitch Frequency Correction Unit

BEST MODE FOR CARRYING OUT THE INVENTION

Next, embodiments of the present invention will be described with reference to the drawings.

<First Exemplary Embodiments>

Figure 1:
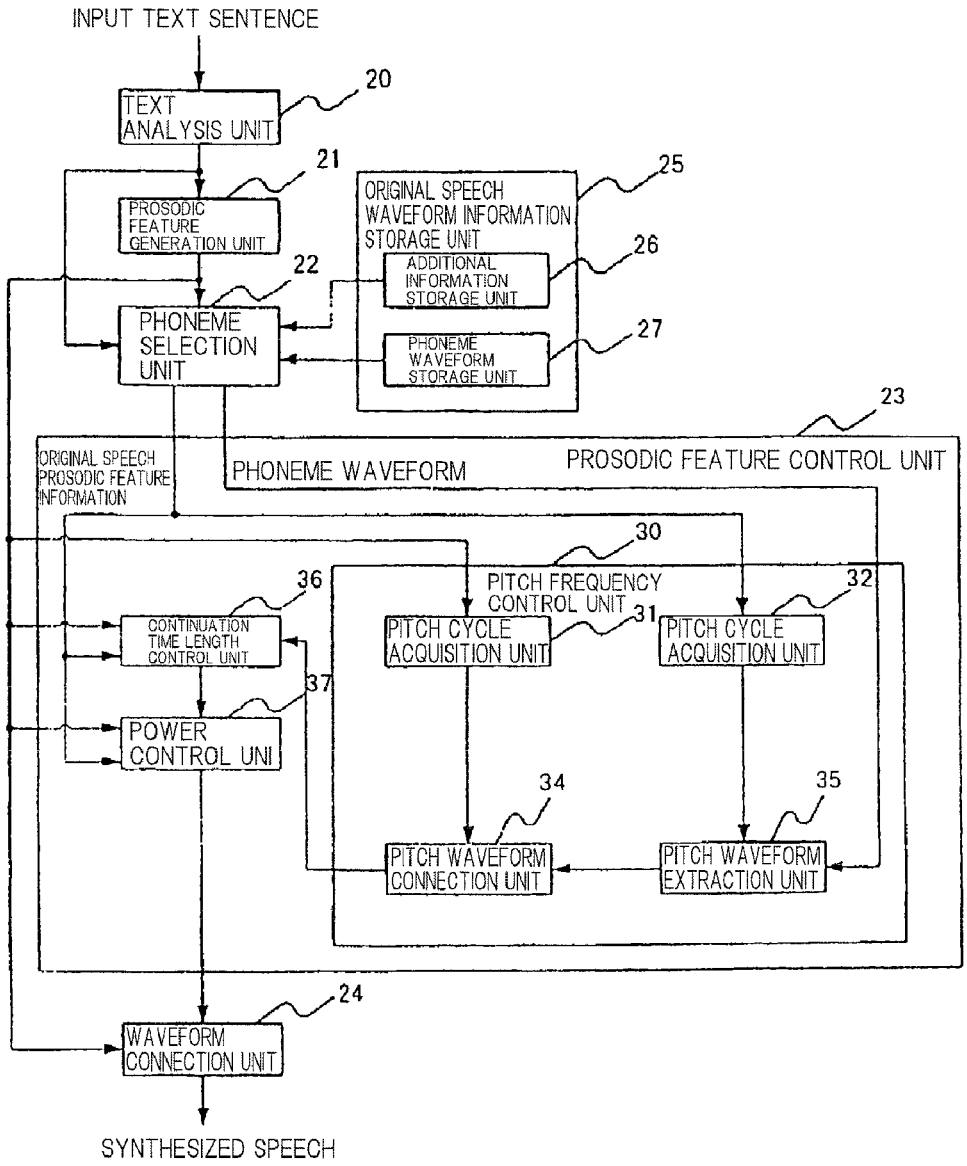
FIG. 1

FIG. 2 is a block diagram generally showing the configuration of a speech synthesis device which is a first exemplary embodiment of the present invention. The speech synthesis device of this embodiment is characterized in that pitch cycle correction unit 40 is newly provided in the configuration shown in FIG. 1. The configuration except for pitch cycle correction unit 40 is basically the same as the configuration shown in FIG. 1. Here, for avoiding repetitions of the description on the configuration, the configuration and operation of pitch cycle correction unit 40, which is a characteristic part, will be described in detail, while omitting descriptions on the same components.

A synthesized speech pitch cycle acquired by pitch cycle acquisition unit 31 is supplied to pitch cycle correction unit 40. An original speech pitch cycle acquired by pitch cycle acquisition unit 32 is supplied to pitch cycle correction unit 40 and pitch waveform extraction unit 35. In the speech synthesis device of this embodiment, pitch cycle correction unit 40 corrects the synthesized speech pitch cycle supplied from pitch cycle acquisition unit 31 based on the original speech pitch cycle supplied from pitch cycle acquisition unit 32. Then, pitch waveform connection unit 34 connects pitch waveforms extracted by pitch waveform extraction unit 35 at intervals of the synthesized speech pitch cycle corrected by pitch cycle correction unit 40.

FIG. 3 shows the configuration of pitch cycle correction unit 40. Referring to FIG. 3, pitch cycle correction unit 40 comprises small amplitude noise suppression filter 1, fluctuation component extraction unit 2, and synthesized speech pitch cycle correction unit 3. A synthesized speech pitch cycle from pitch cycle acquisition unit 31 is supplied to synthesized speech pitch cycle correction unit 3. An original speech pitch cycle from pitch cycle acquisition unit 32 is supplied to small amplitude noise suppression filter 1 and fluctuation component extraction unit 2, respectively.

Small-amplitude noise suppression filter 1 selectively suppresses only a fluctuation component of the original speech pitch cycle supplied from pitch cycle acquisition unit 32, and supplies fluctuation component extraction unit 2 with a pitch cycle in which the fluctuation component is suppressed. For purposes of maintaining large fluctuations in a pitch cycle string while selectively suppressing only the fluctuation component of the pitch cycle, small amplitude noise suppression filter 1 is employed. Small-amplitude suppression filter 1 is a filter which does not suppress a large-amplitude component (a signal which has a large amplitude/power and which is dominantly comprised of low frequency components) included in a signal, but selectively suppresses only a small-amplitude noise component (a signal which has a small amplitude/power and is dominantly comprised of high frequency components) in the field of signal processing. Typically, a filter for suppressing small-amplitude random noise multiplexed on a signal including sporadical changes such as an image signal is utilized as small-amplitude noise suppression filter 1.

When an ordinarily linear filter is employed to suppress small-amplitude random noise multiplexed on an image signal which has sporadic changes called "edges," an original image will be distorted, resulting in degraded image quality. For suppressing noise will preventing the image quality from degrading, a small-amplitude noise suppression non-linear filter is used such as a median filter, a stack filter or the like (see a document: Kawamata, Taguchi, Muraoka, "Two-Dimensional Signal and Image Processing," Society of Instrument and Control Engineers, 1996). When a pitch cycle string is regarded as one type of time string signal, it can be applied such that a fluctuation component and a small-amplitude noise component which are included in the pitch cycle sequence have a similar nature. The same can be applied to the relationship between a pitch cycle string free of fluctuations and a large-amplitude component. Therefore, by processing a pitch cycle string using a small-amplitude noise suppression filter such as a median filter, a stack filter or the like, only the fluctuation component of the pitch cycle can be suppressed while maintaining large fluctuations in the pitch cycle string.

The following description will be given of a case where an ϵ filter is used as small-amplitude noise suppression filter 1. In this regard, details of the ϵ filter are described in the document (Arakawa, Matsuura, Watabe, Arakawa, "A Method of Reducing Noise for Speech Signals Using Component Separating ϵ- Filters," Transactions A of Institute of Electronics, Information, and Communication Engineers, vol. J85-A, No. 10, pp. 1059-1069, 2002).

Pitch cycle tk' which has a suppressed fluctuation component is given by the following equation, when the E filter is used, where a frame number is k (where k=0, 1, 2, . . . ), and an original speech pitch cycle is tk:

$$t'_k = t_k + \sum_{j=-N}^{N} a_j F(t_{k+j} - t_k) \quad \text{[Expression 2]}$$

where aj represents a filter coefficient, N represents a window length of the filter, and F represents a non-linear function. Filter coefficient aj and non-linear function F are given by the following equations, respectively:

$$a_j = \frac{1}{2N+1} \quad \text{[Expression 3]}$$

$$F(x) = \begin{cases} 0 & x < -\varepsilon \\ x & -\varepsilon \le x \le \varepsilon \\ 0 & \varepsilon < x \end{cases}$$

where ϵ is a constant.

As small-amplitude suppression filter 1, a median filter, a stack filter, or a small-amplitude noise suppression filter for use in image signal processing can be used other than the ϵ filter.

Fluctuation component extraction unit 2 extracts a fluctuation component included in an original speech pitch cycle based on an original speech pitch cycle supplied from pitch cycle acquisition unit 32 and a fluctuation component suppressed pitch cycle supplied from small-amplitude noise suppression filter 1, and supplies the extracted fluctuation component to synthesized speech pitch cycle correction unit 3. The simplest method of extracting the fluctuation component from the original speech pitch cycle is a method of subtracting the fluctuation component suppressed pitch cycle from the original speech pitch cycle. In this event, when fluctuation component Δ tk is given by the following equation, the original speech pitch cycle is tk, and the fluctuation component suppressed pitch cycle is tk':

$$\Delta t_k = t_k - t'_k \quad \text{[Expression 4]}$$

Other than the foregoing, a method of subtraction in a frequency domain is also effective. Specifically, in this method, a pitch cycle string is regarded as one type of time-series signal in a manner similar to small-amplitude noise suppression filter processing, and the original speech pitch cycle and fluctuation component suppressed pitch cycle are converted into a frequency domain, and the difference between both frequency components is converted into a time domain. In this method, frequency component Δ Fk(ω) of the fluctuation component is given by the following equation, where a frequency component of the original speech pitch cycle is Fk(ω), and a frequency component of the fluctuation component suppressed pitch cycle is Fk'(ω):

$$\Delta F_k(\omega) = F_k(\omega) - F'_k(\omega) \quad \text{[Expression 5]}$$

Then, ΔFk(ω) converted into the time domain is eventually output from fluctuation component extraction unit 2. In this way, the method of extracting a signal through subtraction in a frequency domain is known as a spectral subtraction scheme particularly in the field of speech signal processing (Document: S.F. Boll, "Suppression of Acoustic Noise in Speech Using Spectral Subtraction," IEEE Transactions on Acoustics, Speech, and Signal Processing, Vol. ASSP-27, No. 2, pp. 113-120, April 1979). Fourier transform is generally used for frequency domain conversion and for inverse conversion thereof. Since the method of extracting a signal through subtraction in the frequency domain requires frequency domain conversion and inverse conversion, it involves a larger amount of processing than when subtraction is performed in the time domain, but results in an improved extraction accuracy of the fluctuation component.

Synthesized speech pitch cycle correction unit 3 corrects the synthesized speech pitch cycle based on the synthesized speech pitch cycle supplied from pitch cycle acquisition unit 31 and the fluctuation component supplied from fluctuation component extraction unit 2, and supplies the corrected synthesized speech pitch cycle to pitch waveform connection unit 34 in FIG. 2. A method which implements the correction for the synthesized speech pitch cycle in the simplest manner is a method of adding the fluctuation component to the synthesized speech pitch cycle. In this event, corrected pitch cycle Tk' is given by the following equation, where the synthesized speech pitch cycle is Tk, and the fluctuation component is ΔTk:

$$T'_k = T_k + \Delta t_k \quad \text{[Equation 6]}$$

Other than the foregoing, a method of correcting a synthesized speech pitch cycle in the frequency domain is also effective, as is the case with fluctuation component extraction unit 2. By reflecting fluctuations included in the original speech pitch cycle in the synthesized speech pitch cycle, it is possible to alleviate the sensation of noise caused by fluctuations in pitch cycle, thus improving the sound quality of synthesized speech.

Figure 4:
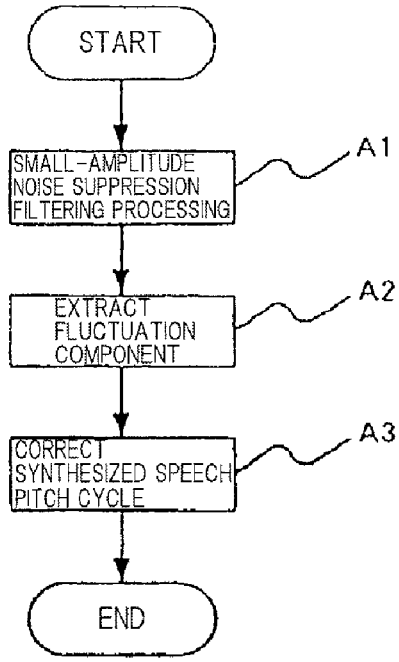

FIG. 4 is a flow chart for describing a correction operation by pitch cycle correction unit 40. In pitch cycle correction unit 40, first, small-amplitude noise suppression filter 1 selectively suppresses only the fluctuation component of the original speech pitch cycle supplied from pitch cycle acquisition unit 32 (step A1). Next, fluctuation component extraction unit 2 extracts the fluctuation component included in the original speech pitch cycle based on the original speech pitch cycle supplied from pitch cycle acquisition unit 32 and the fluctuation component suppressed pitch cycle supplied from small-amplitude noise suppression filter 1. Then, synthesized speech pitch cycle correction unit 3 corrects the synthesized speech pitch cycle based on the synthesized speech pitch cycle supplied from pitch cycle acquisition unit 31 and the fluctuation component supplied from fluctuation component extraction unit 2 (step A3). The synthesized speech pitch cycle thus corrected is supplied to pitch waveform connection unit 34, and pitch waveform connection unit 34 connects pitch waveforms extracted by pitch waveform extraction unit 35 at intervals of the corrected synthesized speech pitch cycle.

According to the speech synthesis device of this embodiment, a fluctuation component of a pitch cycle is extracted from an original speech waveform, and a pitch cycle of synthesized speech is corrected on the basis of the extracted fluctuation component, so that fluctuation components of the pitch cycle can be suppressed irrespective of a window width of moving average. Also, since a small-amplitude noise suppression filter is utilized for extracting the fluctuation component of the original speech pitch cycle, the fluctuation component can be highly accurately extracted even when the fluctuation component is large or even when a sudden change of pitch occurs within the original speech pitch cycle string. Since synthesized speech is generated by reflecting the highly accurately extracted fluctuation component in the synthesized speech pitch cycle, the sensation of noise caused by fluctuations in pitch cycle is alleviated, resulting in an improved sound quality of the synthesized speech.

<Second Exemplary Embodiment>

FIG. 5 is a block diagram generally showing the configuration of a speech synthesis device which is a second exemplary embodiment of the present invention. In the speech synthesis device of this embodiment, pitch cycle correction unit 40 is replaced with pitch cycle correction unit 41 in the configuration shown in FIG. 2. The configuration except for pitch cycle correction unit 41 is basically the same as the configuration shown in FIG. 2. Here, to avoid repeating the description on the configuration, the configuration and operation of pitch cycle correction unit 41, which is a characteristic part, will be described in detail, while descriptions on the same components will be omitted.

FIG. 6 shows the configuration of pitch cycle correction unit 41. Referring to FIG. 6, pitch cycle correction unit 41 comprises conversion ratio calculation unit 5, small-amplitude noise suppression filter 6, and synthesized speech pitch cycle correction unit 7. A synthesized speech pitch cycle acquired by pitch cycle acquisition unit 31 is supplied to conversion ratio calculation unit 5. An original speech pitch cycle acquired by pitch cycle acquisition unit 32 is supplied to conversion ratio calculation unit 5 and synthesized speech pitch cycle correction unit 7, respectively. Conversion ratio calculation unit 5 calculates the conversion ratio of the original speech pitch cycle supplied from pitch cycle acquisition unit 32 to the synthesized speech pitch cycle supplied from pitch cycle acquisition unit 31, and supplies the calculated conversion ratio to small-amplitude noise suppression filter 6. Conversion ratio Rk is given by the following equation, where the original speech pitch cycle is tk, and the synthesized speech pitch cycle is Tk:

$$R_k = \frac{T_k}{t_k} \quad \text{[Expression 7]}$$

Small-amplitude noise suppression filter 6 processes the conversion ratio supplied from conversion ratio calculation unit 5 with a small-amplitude noise suppression filter, and supplies the processed conversion ratio to synthesized speech pitch cycle correction unit 7. Since no fluctuation of pitch cycle exists in the synthesized speech pitch cycle, fluctuations of the original speech pitch cycle are reflected in the conversion ratio. For purpose of suppressing the fluctuations, the conversion ratio is regarded as a time string signal in a manner similar to the first embodiment, and the conversion ratio is filtered using a small-amplitude noise suppression filter as described in the first embodiment. In this way, a conversion ratio can be found in which the influence of the fluctuation component is suppressed.

Synthesized speech pitch cycle correction unit 7 corrects the synthesized speech pitch cycle based on the original speech pitch cycle supplied from pitch cycle acquisition unit 32 and the conversion ratio supplied from small-amplitude noise suppression filter 6, and supplies the corrected synthesized speech pitch cycle to pitch waveform connection unit 34 shown in FIG. 5.

Corrected synthesized speech pitch cycle Tk' is given by the following equation, where the original speech pitch cycle supplied from pitch cycle acquisition unit 32 is tk, and the conversion ratio supplied from small-amplitude noise suppression filter 6 is Rk':

$$T'_k = R'_k t_k \quad \text{[Expression 8]}$$

In this regard, if the conversion ratio calculated by conversion ratio calculation unit 5 is not filtered by small-amplitude noise suppression filter 6, i.e., if the conversion ratio calculated by conversion ratio calculation unit 5 is regarded as Rk, and if this conversion ratio Rk is substituted into conversion ratio Rk' in the foregoing equation to calculate corrected synthesized speech pitch cycle Tk', the synthesized speech pitch cycle before the correction matches with the synthesized speech pitch cycle after the correction. By sufficiently suppressing the fluctuation component of the conversion ratio, fluctuations in the pitch cycle included in the original speech pitch cycle are exactly reflected in the corrected synthesized speech pitch cycle. As a result, the sensation of noise caused by fluctuations in pitch cycle is alleviated, resulting in an improved sound quality of the synthesized speech, as is the case with the first embodiment.

Figure 7:
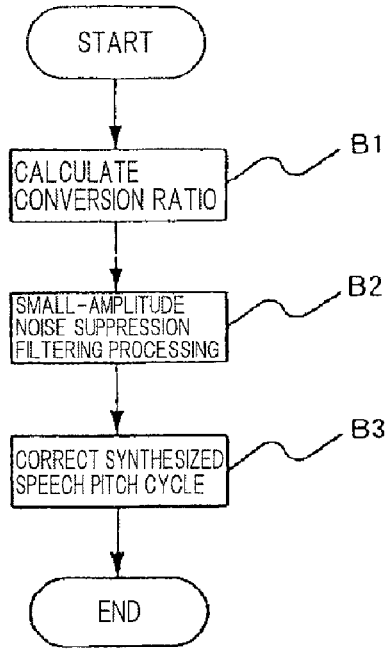

FIG. 7 is a flow chart for describing a correction operation by pitch cycle correction unit 41. In pitch cycle correction unit 41, conversion ratio calculation unit 5 first calculates a conversion ratio of an original speech pitch cycle supplied from pitch cycle acquisition unit 32 to a synthesized speech pitch cycle supplied from pitch cycle acquisition unit 31 (step B1). Next, small-amplitude noise suppression filter 6 performs filtering processing in order to suppress fluctuations of the original speech pitch cycle which appear in the conversion ratio supplied from conversion ratio calculation unit 5 (step B2). Then, synthesized speech pitch cycle correction unit 7 corrects the synthesized speech pitch cycle based on the original speech pitch cycle supplied from pitch cycle acquisition unit 32 and the conversion ratio supplied from small-amplitude noise suppression filter 6 (step B3). The synthesized speech pitch cycle thus corrected is supplied to pitch waveform connection unit 34, and pitch waveform connection unit 34 connects pitch waveforms extracted by pitch waveform extraction unit 35 at intervals of the corrected synthesized speech pitch cycle.

According to the speech synthesis device of this embodiment, since a small-amplitude noise suppression filter is used to suppress a fluctuation component which appears in the conversion ratio calculated by conversion ratio calculation unit 5, the fluctuation component can be suppressed without damaging large fluctuations in the conversion ratio even when the fluctuation component is large or even when a sudden change of pitch occurs within the conversion ratio. Since the conversion ratio the fluctuation component of which has been sufficiently suppressed is used to generate a synthesized speech pitch cycle from an original speech pitch cycle, the sensation of noise caused by fluctuations in pitch cycle is alleviated, resulting in an improved sound quality of the synthesized speech.

<Third Exemplary Embodiment>

FIG. 8 is a block diagram generally showing the configuration of a speech synthesis device which is a third exemplary embodiment of the present invention. In the speech synthesis device of this embodiment, pitch cycle correction unit 40 is replaced with pitch cycle correction unit 42 in the configuration shown in FIG. 2. The configuration except for pitch cycle correction unit 42 is basically the same as the configuration shown in FIG. 2. Here, for avoiding repetitions of the description on the configuration, the configuration and operation of pitch cycle correction unit 42, which is a characteristic part, will be described in detail, while omitting descriptions on the same components.

Figure 9:
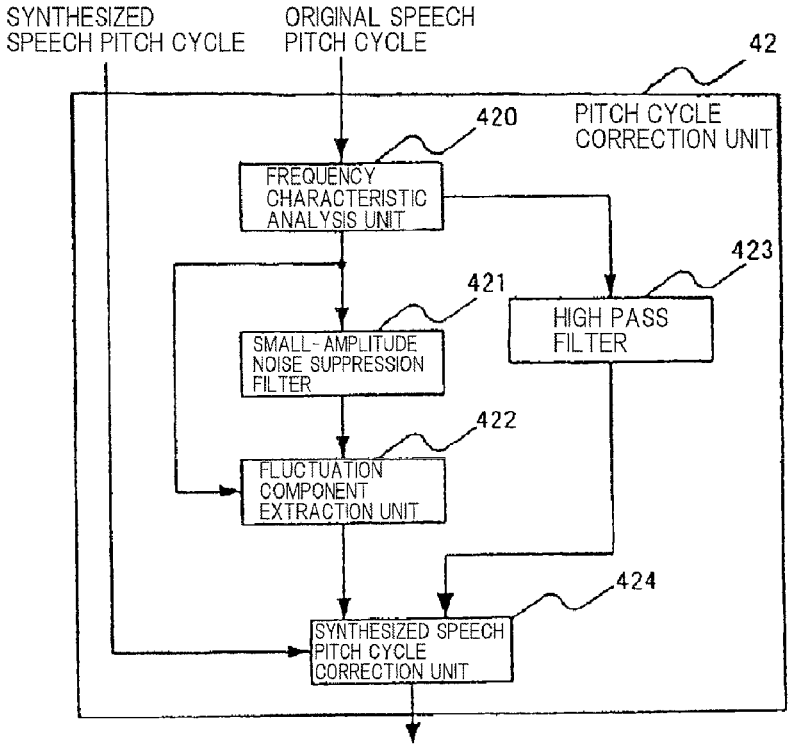

FIG. 9 shows the configuration of pitch cycle correction unit 42. Referring to FIG. 9, pitch cycle correction unit 42 comprises frequency characteristic analysis unit 420, small-amplitude noise suppression filter 421, fluctuation component extraction 422, high pass filter 423, and synthesized speech pitch cycle correction unit 424. A synthesized speech pitch cycle acquired by pitch frequency acquisition unit 31 is supplied to synthesized speech pitch cycle correction unit 424. The original speech pitch cycle acquired by pitch cycle acquisition unit 32 is supplied to frequency characteristic analysis unit 420.

Frequency characteristic analysis unit 420 analyzes the frequency characteristic of an original speech pitch cycle string supplied from pitch cycle acquisition unit 32, and supplies an original speech pitch cycle to high pass filter 423 or small-amplitude noise suppression filter 421 depending on the analysis result. When the original speech pitch cycle is supplied to high pass filter 423, the original speech pitch cycle is also supplied to fluctuation component extraction 422.

Figure 10A:
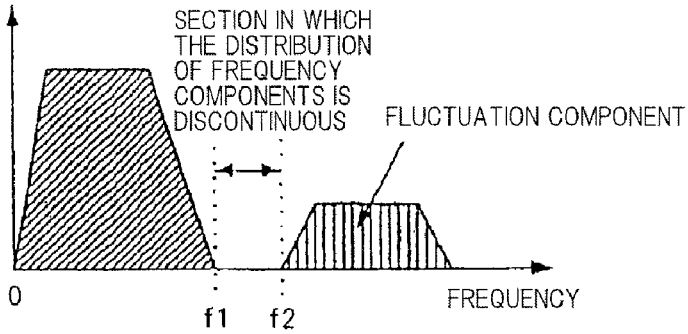
Figure 10B:
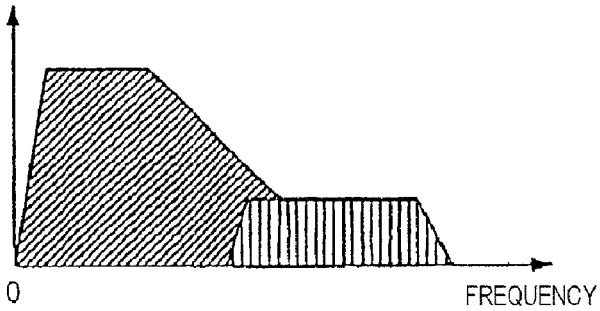

Since a fluctuation component is dominantly comprised of high frequency components, the fluctuation component and original speech pitch cycle string will not overlap in a frequency band when there is no sudden change in the original speech pitch cycle string which does not include the fluctuation component, i.e., when original speech pitch cycle string includes low frequency components alone. Thus, the fluctuation component can be highly accurately extracted by using only a high pass filter. On the other hand, when the fluctuation component and original speech pitch cycle string overlap in frequency band, extraction with a high pass filter is difficult. FIG. 10 shows exemplary frequency characteristics of the original speech pitch cycle string. FIG. 10A shows a case where the fluctuation component and original speech pitch cycle string do not overlap in a frequency band, while FIG. 10B shows a case where the fluctuation component and original speech pitch cycle string overlap in a frequency band.

When there is no overlap in the frequency band as shown in FIG. 10A, frequency characteristic analysis unit 420 supplies the original speech pitch cycle supplied from pitch cycle acquisition unit 32 to high pass filter 423. Conversely, when frequency bands overlap as shown in FIG. 10B, frequency characteristic analysis unit 420 supplies the original speech pitch cycle supplied from pitch cycle acquisition unit 32 to small-amplitude noise suppression filter 421. In this regard, when frequency bands never overlap, extraction of the fluctuation component is simply performed by the high pass filter, so that frequency characteristic analysis unit 420, small-amplitude noise suppression filter 421, and fluctuation component extraction unit 422 are not required in the configuration of FIG. 9.

A method of confirming overlap of frequency bands may be a method of examining continuity of frequency components in an original speech pitch cycle string. When there is no continuous distribution of frequency components from a low frequency range to a high frequency range, i.e., when the distribution of frequency components is discontinuous, as shown in FIG. 10A, it is determined that there is no overlap in the frequency band. On the other hand, when the distribution of frequency components from a low frequency range to a high frequency range is continuous, as shown in FIG. 10B, it is determined that the frequency bands overlap.

Figure 11:
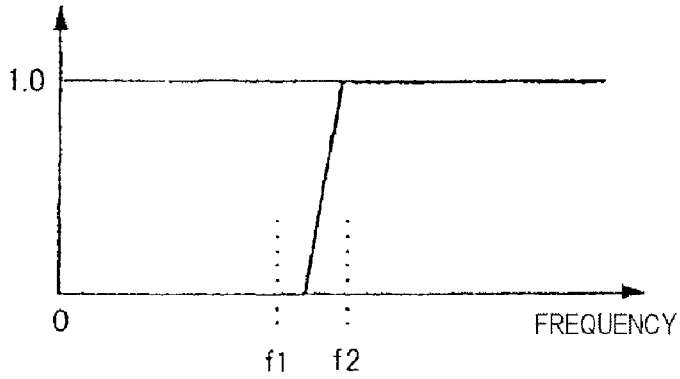

High pass filter 423 performs high pass filtering processing on the original speech pitch cycle supplied from frequency analysis unit 420 to extract the fluctuation component and supplies the extracted fluctuation component to synthesized speech pitch cycle correction unit 424. For highly accurately extracting only the fluctuation component in high pass filter 423, the filter must be designed in accordance with the analysis result of frequency characteristic analysis unit 424. Specifically, high pass filter 423 is designed to define a pass band which is higher than a band in which discontinuity of frequency components is found in the original speech pitch cycle string. For example, when the frequency characteristic is exhibited as shown in FIG. 10A, high pass filter 423 is designed to have a frequency characteristic which allows frequencies in a band higher than frequency f1 (the lowest frequency in a discontinuous section of frequency components) to pass through. See, for example, the frequency characteristic as shown in FIG. 11.

A method of designing a filter which implements a given band characteristic is disclosed, for example, in a document (Tanihagi, "Theory of Digital Signal Processing," Vol. 2, Corona Publishing Co. Ltd, 1985). When the frequency characteristic of the fluctuation component is known, calculations required to design a filter can be omitted by employing a method in which a previously designed filter, through which only the fluctuation component, is used at all times when the high pass filtering processing is performed.

Figure 12:
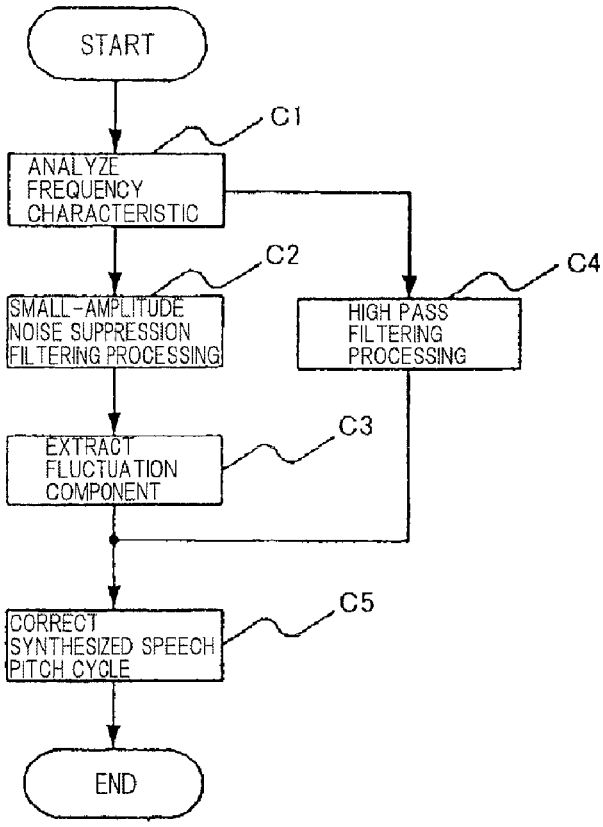

FIG. 12 is a flow chart for describing a correction operation by pitch cycle correction unit 42. In pitch cycle correction unit 42, frequency characteristic analysis unit 420 first analyzes the frequency characteristic of an original speech pitch cycle string supplied from pitch cycle acquisition unit 32 to determine whether or not a fluctuation component and the original speech pitch cycle string overlap in frequency band (step C1).

Upon determining in the frequency characteristic analysis at step C1 that the fluctuation component and original speech pitch cycle string do not overlap in the frequency band, frequency characteristic analysis unit 420 supplies the original speech pitch cycle supplied from pitch cycle acquisition unit 32 to small-amplitude noise suppression filter 421 and fluctuation extraction unit 422. Next, small-amplitude noise suppression filter 421 selectively suppresses only the fluctuation component of the original speech pitch cycle supplied from frequency characteristic analysis unit 420 (step C2). Then, fluctuation extraction unit 422 extracts the fluctuation component included in the original speech pitch cycle based on the original speech pitch cycle supplied from frequency characteristic analysis unit 420 and a fluctuation component suppressed pitch cycle supplied from small-amplitude noise suppression filter 421 (step C3). This extracted fluctuation component is supplied to synthesized speech pitch cycle correction unit 424.

Upon determining in the frequency characteristic analysis at step C1 that the fluctuation component and original speech pitch cycle string overlap in the frequency band, frequency characteristic analysis unit 420 supplies the original speech pitch cycle supplied from pitch cycle acquisition unit 32 to high pass filter 423. Then, high pass filter 423 performs high pass filtering processing on the original speech pitch cycle supplied from frequency characteristic analysis unit 420 to highly accurately extract the fluctuation component (step C4). This extracted fluctuation component is supplied to synthesized speech pitch cycle correction unit 424.

As the fluctuation component is extracted at step C3 or step C4, synthesized speech pitch cycle correction unit 424 corrects the synthesized speech pitch cycle based on the extracted fluctuation component and the synthesized speech pitch cycle supplied from pitch cycle acquisition unit 31 (step C5). The synthesized speech pitch cycle thus corrected is supplied to pitch waveform connection unit 34, and pitch waveform connection unit 34 connects pitch waveforms extracted by pitch waveform extraction unit 35 at intervals of the corrected synthesized speech pitch cycle.

According to the speech synthesis device of this embodiment, it is possible to perform the switching between the highly accurate extraction of the fluctuation component, which is performed by high pass filter 423, and the extraction of the fluctuation component, which is performed by small-amplitude noise suppression filter 421 and fluctuation component extraction unit 422, in accordance with the analysis result of the frequency characteristic of the original speech pitch cycle string. As compared with the first embodiment which uses the small-amplitude noise suppression filter at all times, the extraction of the fluctuation component can be improved due to the ability of low pass filter 432 to remove the fluctuation component with highly accuracy, and the amount of processing can also be reduced when the fluctuation component is extracted.

When, at all times, the frequency characteristic of the original speech pitch cycle string supplied from pitch cycle acquisition unit 32 is the characteristic which is discontinuous, as shown in FIG. 10A, and when the frequency characteristic of the fluctuation component is known, frequency characteristic analysis unit 420, small-amplitude noise suppression filter 421, and fluctuation component extraction unit 422 are not required, thus making it possible to correspondingly reduce the device cost.

<Fourth Exemplary Embodiment>

FIG. 13 is a block diagram generally showing the configuration of a speech synthesis device which is a fourth exemplary embodiment of the present invention. In the speech synthesis device of this embodiment, pitch cycle correction unit 40 is replaced with pitch cycle correction unit 43 in the configuration shown in FIG. 2. The configuration except for pitch cycle correction unit 43 is basically the same as the configuration shown in FIG. 2. Here, to avoid repeating a description on the configuration, the configuration and operation of pitch cycle correction unit 43, which is a characteristic part, will be described in detail, while omitting descriptions on the same components.

FIG. 14 shows the configuration of pitch cycle correction unit 43. Referring to FIG. 14, pitch cycle correction unit 43 comprises conversion ratio calculation unit 430, frequency characteristic analysis unit 4311 low pass filter 432, small-amplitude noise suppression filter 433, and synthesized speech pitch cycle correction unit 434. A synthesized speech pitch cycle acquired by pitch cycle acquisition unit 31 is supplied to conversion ratio calculation unit 430. An original speech pitch cycle acquired by pitch cycle acquisition unit 32 is supplied to conversion ratio calculation unit 430 and synthesized speech pitch cycle correction unit 434, respectively.

Conversion ratio calculation unit 430 calculates a conversion ratio of the original speech pitch cycle supplied from pitch cycle acquisition unit 32 to the synthesized speech pitch cycle supplied from pitch cycle acquisition unit 31, and supplies the calculated conversion ratio to frequency characteristic analysis unit 431.

Frequency characteristic analysis unit 431 analyzes the frequency characteristic of the conversion ratio supplied from conversion ratio calculation unit 430, and supplies the conversion ratio to low pass filter 432 or small-amplitude noise suppression filter 433 in accordance with the analysis result. The frequency characteristic analysis on the conversion ratio is similar to the frequency characteristic analysis on the original speech pitch cycle, described in the third embodiment. When there is no continuous distribution of frequency components of the conversion ratio from a low frequency band to a high frequency band, i.e., there is a frequency component that is not continuously distributed, no overlapping frequency bands exist, so that frequency characteristic analysis unit 431 selects low pass filter 432 as the destination of the conversion ratio. Conversely, when distribution of the frequency components of the conversion ratio from the low frequency range to the high frequency range is continuous, small-amplitude noise suppression filter 433 is selected as the destination of the conversion ratio. In this regard, when overlapping frequency bands never exist, low pass filter 432 always removes a fluctuation component, so that frequency characteristic analysis unit 431 and small-amplitude noise suppression filter 433 are not required in the configuration of FIG. 14.

Low pass filter 432 performs low pass filtering processing on the conversion ratio supplied from frequency characteristic analysis unit 430 to remove a fluctuation component which appears in the conversion ratio, and supplies the conversion ratio, from which the fluctuation component was removed, to synthesized speech pitch cycle correction unit 434. By appropriately designing the filter in accordance with the analysis result of frequency characteristic analysis unit 430, the fluctuation component can be highly accurately removed in a manner similar to the high pass filter in the third embodiment. Specifically, low pass filter 432 is designed such that a pass band is defined in a band that is lower than a band in which distribution of the frequency components of the conversion ratio is not continuous. When the frequency characteristic of the fluctuation component is known, calculations required to design the filter can be omitted in a manner similar to the third embodiment.

Figure 15:
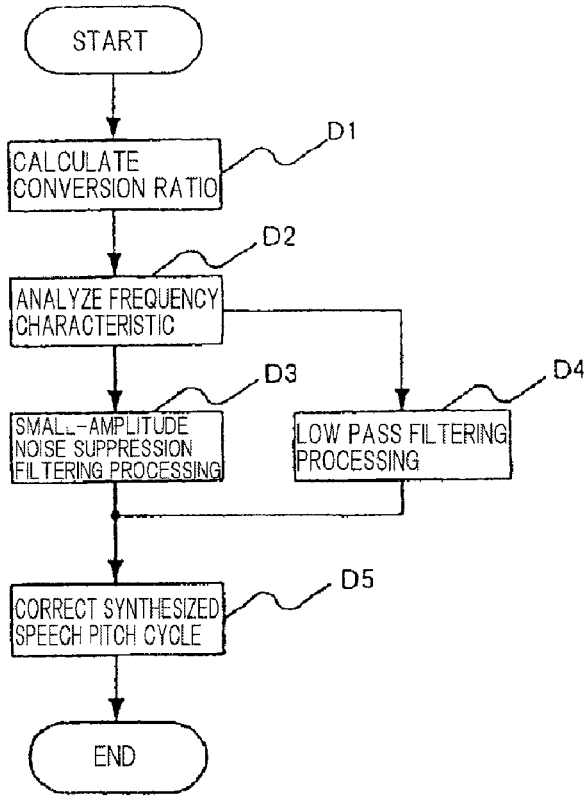

FIG. 15 is a flow chart for describing a correction operation by pitch cycle correction unit 43. In pitch cycle correction unit 43, conversion ratio calculation unit 430 first calculates a conversion ratio of an original speech pitch cycle supplied from pitch cycle acquisition unit 32 to a synthesized speech pitch cycle supplied from pitch cycle acquisition unit 31 (step D1), Next, frequency characteristic analysis unit 431 analyzes the frequency characteristic of the conversion ratio supplied from conversion ratio calculation unit 430 to determine whether or not a fluctuation component and the conversion ratio overlap in frequency band (step D2).

Upon determining in the frequency characteristic analysis at step D2 that the fluctuation component and conversion ratio do not overlap in the frequency band, frequency characteristic analysis unit 431 supplies the conversion ratio supplied from conversion ratio calculation unit 430 to small-amplitude noise suppression filter 433. Then, small-amplitude noise suppression filter 433 selectively suppresses only the fluctuation component of the conversion ratio supplied from frequency characteristic analysis unit 431 (step D3). This conversion ratio, which has only the fluctuation component suppressed therefrom, is supplied from small-amplitude noise suppression filter 433 to synthesized speech pitch cycle correction unit 434.

Upon determining in the frequency characteristic analysis at step D2 that the fluctuation component and conversion ratio overlap in frequency band, frequency characteristic analysis unit 431 supplies the conversion ratio supplied from conversion ratio calculation unit 430 to low pass filter 432. Then, low pass filter 432 performs low pass filtering processing on the conversion ratio supplied from frequency characteristic analysis unit 430 to highly accurately remove the fluctuation component which appears in the conversion ratio (step D4). This conversion ratio, from which the fluctuation component has been highly accurately removed, is supplied from low pass filter to synthesized speech pitch cycle correction unit 434.

When the fluctuation component of the conversion ratio is removed at step D3 or step D4, synthesized speech pitch cycle correction unit 434 corrects the synthesized speech pitch cycle based on the conversion ratio and the original speech pitch cycle supplied from pitch cycle acquisition unit 32 (step D5). The synthesized speech pitch cycle thus corrected is supplied to pitch waveform connection unit 34, and pitch waveform connection unit 34 connects pitch waveforms extracted by pitch waveform extraction unit 35 at intervals of the corrected synthesized speech pitch cycle.

According to the speech synthesis device of this embodiment, it is possible to perform the switching between the highly accurate removal of the fluctuation component by low pass filter 432 and the removal of the fluctuation component by small-amplitude noise suppression filter 433 in accordance with the analysis result of the frequency characteristic of the original speech pitch cycle string. As compared with the second embodiment which uses the small-amplitude noise suppression filter at all times, the amount of processing can be reduced without compromising the fluctuation component removal accuracy due to the ability of low pass filter 432 to remove the fluctuation component with highly accuracy. If the fluctuation component can be removed by the low pass filter at all times, and if the frequency characteristic of the fluctuation component is known, the frequency characteristic analysis unit and small-amplitude noise suppression filter are not required, thus making it possible to correspondingly reduce the device cost.

The present invention is not limited to the speech synthesis device described in each embodiment, but the configuration and operation thereof can be modified as appropriate without departing from the spirit of the invention. For example, while the speech synthesis device of each embodiment uses a pitch waveform as a synthesized speech prosodic feature changing scheme, the present invention is not so limited. The present invention can also be applied to a scheme which uses, for example, a predicted residual waveform of linear prediction analysis.

Also, the present invention can also be applied to a scheme which uses a pitch frequency instead of a pitch cycle.

Further, it is assumed that the fluctuation component is an estimation error of a pith cycle which is produced when the pitch cycle is determined from an original speech waveform. Accordingly, the fluctuation component extraction unit may output, as a fluctuation component, an estimation error of a pitch cycle of an acquired original speech waveform, the estimation error being determined from the original speech waveform.

Further, when a true original speech pitch cycle and a fluctuation component are regarded as distinct types of signals, the fluctuation component is a signal which has a smaller amplitude and power than those of the true original speech pitch cycle, and which is dominantly comprised of high frequency components. Therefore, the fluctuation component extraction unit may extract, as a fluctuation component, a component which is included in the pitch cycle of the original speech waveform, which has an amplitude smaller than other components, and which is dominantly comprised of high frequency components.

Also, any speech synthesis device of each embodiment is implemented in a computer system represented by a personal computer or the like, and its speech synthesis operation can be implemented in software. The computer system comprises a storage device for storing a program and the like, an input device such as a keyboard, a mouse or the like, a display device such as CRT, LCD or the like, a communication device such as a modem for communicating with the outside, an output device such as a printer, and a control device (CPU) for controlling the operation of the communication device, output device, and display device in response to an input from the input device. A program and data for causing the control device to execute the speech synthesis operation described in each embodiment are stored in the storage device. This program may be provided by a recording medium such as CD-ROM, DVD and the like, or may be provided from an external device through a communication device.

This application claims the priority based on Japanese Patent Application No. 2006-199228 filed Jul. 21, 2007, the disclosure of which is incorporated herein by reference in its entirety.

The invention claimed is:

1. A speech synthesis device, which includes a storage unit which stores original speech waveforms that have been previously acquired, for generating synthesized speech corresponding to an input text sentence based on an original speech waveform stored in said storage unit, said speech synthesis device comprising:

a conversion ratio calculation unit that calculates a conversion ratio of a pitch cycle of a pitch waveform which is obtained from said storage unit and which constitutes an original speech waveform for generating the synthesized speech to a pitch cycle of the synthesized speech obtained by analyzing the input text sentence;

a fluctuation component suppression unit that suppresses a fluctuation component of a pitch cycle of a pitch waveform of the original speech waveform, the fluctuation component being reflected in the conversion ratio calculated by said conversion ratio calculation unit;

a synthesized speech pitch cycle correction unit that corrects the pitch cycle of the synthesized speech based on the pitch cycle of the pitch waveform of the original speech waveform and the conversion ratio in which the fluctuation component is suppressed by said fluctuation component suppression unit; and a pitch waveform connection unit that connects, at the pitch cycle of the synthesized speech corrected by said synthesized speech pitch cycle correction unit, the pitch waveform of the original speech waveform obtained from said storage unit.

2. The speech synthesis device according to claim 1, wherein said fluctuation component is a component included in the conversion ratio, and is a component which has an amplitude smaller than other components and which is dominantly comprised of high frequency components.

3. The speech synthesis device according to claim 1, wherein said fluctuation component suppression unit comprises a small-amplitude noise suppression filter that selectively suppresses only the fluctuation component of the pitch cycle of the original speech waveform, the fluctuation component being reflected in the conversion ratio.

4. The speech synthesis device according to claim 1, wherein said fluctuation component suppression unit comprises a low pass filter that suppresses, as the fluctuation component, a low frequency component of the pitch cycle of the original speech waveform, said low frequency component being reflected in the conversion ratio.

5. The speech synthesis device according to claim 1, wherein said fluctuation component suppression unit comprises:

a small-amplitude noise suppression filter that selectively suppresses only the fluctuation component of the pitch cycle of the original speech waveform, the fluctuation component being reflected in the conversion ratio;

a low pass filter that suppresses, as the fluctuation component, a low frequency component of the pitch cycle of the original speech waveform, the low frequency component being reflected in the conversion ratio; and a frequency characteristic analysis unit that analyzes the frequency characteristic of the conversion ratio, and that selects a filter for use in suppression of the fluctuation component from said small-amplitude noise suppression filter and said low pass filter in accordance with the analysis result.

6. The speech synthesis device according to claim 1, wherein said synthesized speech pitch cycle correction unit calculates the product of the conversion ratio in which the fluctuation component has been suppressed and the pitch cycle of the original speech waveform, and outputs the product as a corrected pitch cycle of the synthesized speech.

7. A speech synthesis method for referring to a storage unit which stores original speech waveforms which are previously acquired to generate synthesized speech corresponding to an input text sentence based on an original speech waveform stored in said storage unit, comprising:

calculating a conversion ratio between a pitch cycle of a pitch waveform which constitutes an original speech waveform which is obtained from said storage unit in order to generate the synthesized speech and a pitch cycle of the synthesized speech which is derived by analyzing the input text sentence;

suppressing a fluctuation component of the pitch cycle of the pitch waveform of the original speech waveform, said fluctuation component being reflected in the calculated conversion ratio;

correcting the pitch cycle of the synthesized speech based on the pitch cycle of the pitch waveform of the original speech waveform and the conversion ratio in which the fluctuation component has been suppressed; and connecting the pitch waveform of the original speech waveform obtained from said storage unit at the corrected pitch cycle of the synthesized speech.

8. A non-transitory computer readable medium recorded with a program for causing a computer to execute speech synthesis processing for referring to a storage unit which stores original speech waveforms which are previously acquired to generate synthesized speech corresponding to an input text sentence based on an original speech waveform stored in said storage unit, said program causing the computer to execute:

processing for calculating a conversion ratio between a pitch cycle of a pitch waveform which constitutes an original speech waveform which is obtained from said storage unit in order to generate the synthesized speech and a pitch cycle of the synthesized speech which is derived by analyzing the input text sentence;

processing for suppressing a fluctuation component of the pitch cycle of the pitch waveform of the original speech waveform, said fluctuation component being reflected in the calculated conversion ratio;

processing for correcting the pitch cycle of the synthesized speech based on the pitch cycle of the pitch waveform of the original speech waveform and the conversion ratio in which the fluctuation component has been suppressed; and processing for connecting the pitch waveform of the original speech waveform obtained from said storage unit at the corrected pitch cycle of the synthesized speech.

9. A speech synthesis device, which includes a storage unit which stores original speech waveforms that have been previously acquired, for generating synthesized speech corresponding to an input text sentence based on an original speech waveform stored in said storage unit, said speech synthesis device comprising :

a conversion ratio calculation unit for calculating a conversion ratio of a pitch cycle of a pitch waveform which is obtained from said storage unit and which constitutes an original speech waveform for generating the synthesized speech to a pitch cycle of the synthesized speech obtained by analyzing the input text sentence;

fluctuation component suppressing means for suppressing a fluctuation component of a pitch cycle of a pitch waveform of the original speech waveform, the fluctuation component being reflected in the conversion ratio calculated by said conversion ratio calculation unit;

a synthesized speech pitch cycle correction unit for correcting the pitch cycle of the synthesized speech based on the pitch cycle of the pitch waveform of the original speech waveform and the conversion ratio in which the fluctuation component is suppressed by said fluctuation component suppressing means; and a pitch waveform connection unit for connecting, at the pitch cycle of the synthesized speech corrected by said synthesized speech pitch cycle correction unit, the pitch waveform of the original speech waveform obtained from said storage unit.

* * * * *